United States Patent [19]

Hinds

[11] 4,293,125

[45] Oct. 6, 1981

[54] JUMP ROPE HANDLE

[76] Inventor: Robert S. Hinds, 1803 Regent St., Madison, Wis. 53705

[21] Appl. No.: 60,994

[22] Filed: Jul. 27, 1979

Related U.S. Application Data

[63] Continuation-in-part of Ser. No. 866,818, Jan. 4, 1978, abandoned.

[51] Int. Cl.[3] ..... A63B 5/20

[52] U.S. Cl. ..... 272/75; 273/DIG. 1

[58] Field of Search ..... 272/75, 74; 273/81 A, 273/63 E, 59 B, 62, 63 G, DIG. 1, DIG. 9, 81 C; 46/1 G; 128/57

[56] References Cited

U.S. PATENT DOCUMENTS

| | | | |
|---|---|---|---|
| 1,436,703 | 11/1922 | Fisher | 272/75 |
| 2,253,075 | 8/1941 | Johnson | 272/75 |
| 2,723,121 | 11/1955 | Cartwright et al. | 272/75 |
| 2,968,117 | 1/1961 | Trombly | 46/1 G |
| 3,068,007 | 12/1962 | Satchell | 273/63 G |
| 3,517,931 | 6/1970 | Kalish | 272/75 |
| 3,642,277 | 2/1972 | Gersten | 272/75 X |
| 3,669,133 | 6/1972 | Hyman | 272/75 |
| 4,065,537 | 12/1977 | Miller et al. | 273/62 X |
| 4,139,966 | 2/1979 | Connell | 46/1 G |

FOREIGN PATENT DOCUMENTS

| | | | |
|---|---|---|---|
| 2141374 | 2/1973 | Fed. Rep. of Germany | 272/75 |
| 10285 | 6/1909 | France | 272/75 |
| 1116955 | 2/1956 | France | 272/75 |
| 1507343 | 11/1967 | France | 272/75 |
| 2366848 | 6/1978 | France | 272/75 |
| 328469 | 3/1958 | Switzerland | 272/75 |
| 345823 | 5/1960 | Switzerland | 272/75 |
| 354011 | 6/1961 | Switzerland | 272/75 |
| 16952 | of 1891 | United Kingdom | 272/75 |
| 26028 | of 1908 | United Kingdom | 272/75 |
| 6467 | of 1909 | United Kingdom | 272/75 |
| 275261 | 3/1928 | United Kingdom | 128/57 |

*Primary Examiner*—Richard C. Pinkham
*Assistant Examiner*—Arnold W. Kramer
*Attorney, Agent, or Firm*—Keith Schoff

[57] ABSTRACT

A jump rope has tubular handles, each configured with a deeply set annular recess at one end to provide a bearing surface for receiving the knotted end of the rope, and a bell shaped curvilinear egress port at the opposite end on the handle adjacent to which is strung on the rope a substantially spherical bead for preventing jamming of weighting links on the rope into the handle.

5 Claims, 8 Drawing Figures

JUMP ROPE HANDLE

CROSS-REFERENCES

This application is a continuation-in-part of application Ser. No. 866,818 filed Jan. 4, 1978 and since abandoned.

FIELD

This invention relates to a handle for a jump rope and more particularly to a handle having a longitudinal port or tubular portion extending throughout its length to receive a cord which comprises a portion of the jump rope.

PRIOR ART AND SUMMARY

For some time jump ropes have been provided for the conditioning of atheltes which comprise two handles and an elongated member extending between the handles. Braided cord and braided leather have been proposed or used for the cord and various means have been provided at the junctures of the cord with the handles to provide for rotation of the cord with respect to the handles. These have included universal joints of elementary types and have included ball bearings, the outer races of which are received within the handles, the ends of the ropes being received in and attached to the inner races.

In accordance with an improvement on such ropes, a plurality of cylindrical links or tubular members have been strung like beads on a cord, usually braided, of nylon, polypropylene or the like and the ends of the cords have been received in longitudinal tubular portions of handles, the ends of the cord being knotted with knots larger than the portion of the hole through which the ultimate end of the cord extends to prevent the cord from being withdrawn through the handle and to provide for a bearing-like action by reason of rotation of the knot against the "far" end of the handle.

In accordance with the present invention, a relatively larger handle is provided and means are provided to cause the handle to have additional weight, that is, to have a relatively high effective density so that the weight of the two handles substantially exceeds the weight of the cord and the links or tubular members strung thereon. A deep recess is provided in the outer end of each handle to receive the knotted end of the cord so that the knot is more nearly located near the center of the handle than its end, and the inboard end of the handle is configured with flared opening, preferably a curvilinear bell or exponential horn shape to improve the rotational motion of the adjacent portion of the rope which is swung as a bight about an axis through the handles during use. The weighting link strung on the cord nearest a handle is shaped as a spherical bead preferably, although any other operable shape may be used, to roll or slide on the flared surface of the handle facilitating smooth swinging of the cord and preventing jamming of the tubular links into the handle opening.

OBJECTS

It is an object of the invention to provide an improved handle for a jump rope. Further objects will become apparent from the drawings and from the following detailed description.

DRAWINGS

In the drawings, like reference numerals refer to like parts and:

Figure 1:
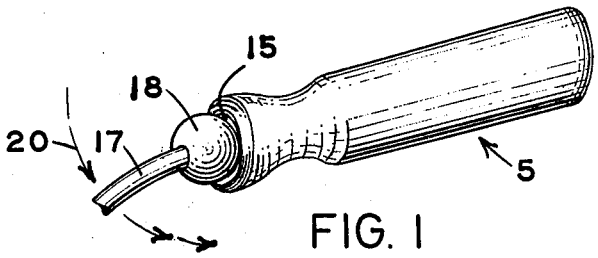
FIG. 1 is a perspective view of a handle in accordance with the invention utilized as a portion of a jump rope.
Figure 2:
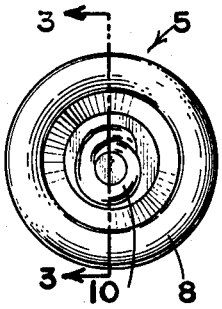
FIG. 2 is an end view of the handle of FIG. 1.
Figure 3:
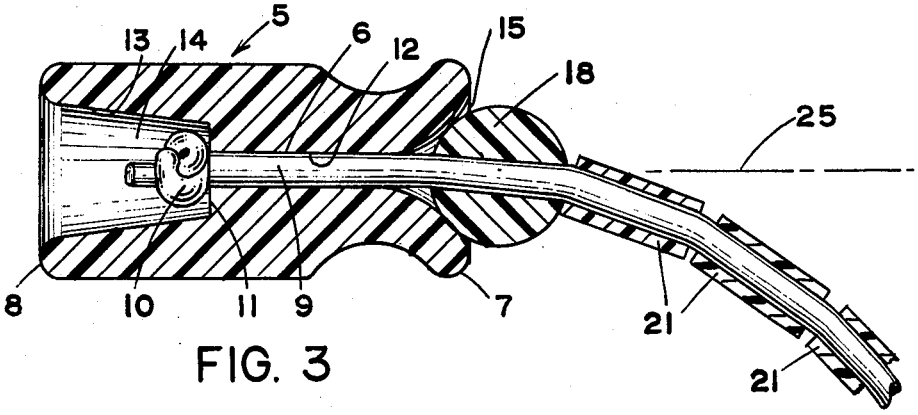
Figure 4:
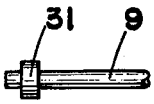
Figure 5:
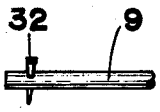
Figure 6:
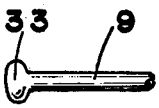
Figure 7:
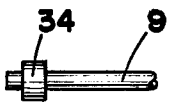
Figure 8:
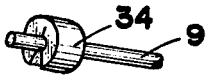

FIG. 3 is a cross-sectional view taken on lines 3—3 in FIG. 2; and FIGS. 4, 5, 6, 7, and 8 are fragmentary elevation views of portions of modifications of the embodiment of FIGS. 1, 2, and 3.

DESCRIPTION

Referring now to the Figures, handle 5 is provided internally with longitudinally extending passage 6 which extends from inner end 7 of handle 5 to outer end 8, and in which cord 9 is received having the end tied into knot 10. Cord 9 may be made of any suitable material such as nylon or polypropylene and may be braided. Knot 10 is received against radially disposed annular surface 11 which defines the terminus of wall 12, which is preferably nearly cylindrically shaped, and that of wall 13 which is preferably conically shaped.

At inner end 7 of handle 5, aperture 6 is provided with a curvilinear, bell shaped portion 15 having the form of a horn patterned as an exponential curve such as a cornet or the like, against which portion spherical link 18 rolls or slides when the latter is strung as the end bead on cord 9 and prevents smaller diameter weighting links 21 from jamming into inner end 7 of handle 5 when the rope is operably swung while being used as a jump rope. The diameter of link 18 is preferably only slightly smaller than the end opening of inner end 7 to provide a contact angle between the link and the handle which is sufficiently great to obviate wedging of the link into the end of the handle. A plurality of tubular links 21 are strung on cord 9 between end beads to weight the cord and cause it to maintain a nearly catenary curve both at high speeds of rotation and when used in a wind or the like. Such weighting beads or links may have any other desirable shape which serves to cause the dynamic action of the device to be improved by the presence of such weighting in comparison to similar, but unweighted cords.

Aperture 6 may extend from end 7 to end 8 of handle 5 in any suitable and operable manner but preferably the various surfaces of apertures 6 and 14 such as surfaces 11, 12 and 13 are symmetrical with respect to axis 25 of handle 5 and it is generally preferred in accordance with the embodiment shown that exterior surfaces of handle 5 also be symmetrical with respect to axis 25.

In place of knot 10, any suitable retaining means may be provided such as a metal clip, a metal or plastic pin extending throught the cord, a melted portion of the cord, a plastic member seized around the cord by mechanical friction such as by reason of shrinkage or by other mechanical means such as pressure, all as indicated respectively at 31, 32, 33 and 34 in FIGS. 4, 5, 6, 7 and 8. Such means are referred to hereinafter and in the claims as an enlarged member or portion associated with the cord since the enlarged member may indeed by a portion of the cord as indicated for knot 10 or a separate member attached to and thereby associated with the cord as indicated for clip 31 or plastic member 34.

Bead-like members or links or tubular links 21(preferably made of synthetic resinous polymeric material by extruding or injection molding) are herinafter referred to in the specification and claims as bead-like members, each being characterized by having an aperture or hole extending therethrough to permit stringing on a cord to thereby provide for retaining it on the cord. The bead-like members may have any suitable exterior configuration. They may be symmetric or may be unsymmetrical with respect to the aforesaid aperture 26. Spherical link 18 is preferably of larger diameter than links 21 and one such link is disposed on cord 9 next adjacent each handle to facilitate smooth rotational movement of cord 9 relative to handle 5 and to prevent jamming of the links 21 into the handle.

Handle 5 is preferably provided with means to cause it to have an apparent density or effective density greater than its density would be if merely made of wood or plastic, that is, synthetic resinous polymeric material. The desired effect may be achieved by manufacturing the handle of metal such as aluminum, brass, or steel, or the like, or may be achieved by providing a metal insert of a heavy metal such as lead or the like, as a portion of handle 5.

However, in accordance with a preferred embodiment, handle 5 is molded from a polymeric synthetic resinous material and included in the composition of the material from which handle 5 is molded is a suitable salt of a heavy metal, lead carbonate being preferred and lead sulphide, lead sulphate, lead oxide, lead nitrate and granular or powdered lead being other possibilities.

It will be apparent to those skilled in the art that equivalents may be utilized.

Accordingly, the present invention may be embodied in other specific forms without departing from the spirit or essential attributes thereof, and accordingly, reference should be made to the appended claims rather than to the foregoing specification as indicating the scope of the invention.

It is preferred in the jump rope of this invention that handles 5 be provided at each end of the jump rope and that a bead 18 be disposed immediately adjacent and inside of each handle 5, the beads 18 preferably being solid throughout pierced only sufficiently for cord 9 to be passed therethrough and configured spherically, but at least with that portion facing handle 5 being hemispherical or substantially so, thereby functionally relating bead 18 and bell shaped portion 15 of handle 5 substantially as bell and ball whereby the parts make freely sliding or rolling contact without sticking or binding. Cord 9 is preferably strung solidly with beads 21, however, with beads 18 at each end of the string of beads having enough free space along the cord to enable knot 10 to be drawn beyond the butt end of one of handles 5 to be retied thereby enabling the cord to be lengthened or shortened to accomodate users of varying statures.

I claim:

1. In a jump rope comprising a cord, two handles, said handles comprising apertures extending therethrough, said cord received in said apertures, said handles retained on said cord by an enlarged portion associated with said cord at each end and a plurality of bead members strung substantially solidly on said cord between said handles, each of said handles having an inner end and an outer end, the combination of a deep recess in the outer end of each of said handles, an annular surface portion at the inner end of each of said recesses for retaining said cord in said handle by said enlarged portion bearing thereon disposed near the center of said handle, the inner end of each said aperture diverging substantially in the form of a bell to receive in engagement the adjacent portion of said cord during use of said jump rope, said bead members disposed next adjacent said handles configured with at least the handle-facing portions thereof configured substantially hemispherically to perform in contact with said handles in the manner of a ball and a hollow bell.

2. The apparatus of claim 1 wherein said handles are molded of synthetic resinous polymeric material having molecules of a heaby metal incorporated therein as part of the molding composition.

3. The apparatus of claim 2 wherein said molecules of a heavy metal are embodied in a lead salt.

4. The apparatus of claim 2 wherein said molecules of a heavy metal are embodied in particles of lead.

5. The apparatus of claim 2 wherein said molecules of a heavy metal are embodied in lead carbonate.

* * * * *